US008578728B2

(12) United States Patent
Cho et al.

(10) Patent No.: US 8,578,728 B2
(45) Date of Patent: Nov. 12, 2013

(54) MOVABLE AIR CONDITIONER

(75) Inventors: Jin-Myeong Cho, Changwon (KR); Il-Soo Jeon, Changwon (KR); Hyung-Gyu Gu, Changwon (KR)

(73) Assignee: LG Electronics Inc., Seoul (KR)

( * ) Notice: Subject to any disclaimer, the term of this patent is extended or adjusted under 35 U.S.C. 154(b) by 201 days.

(21) Appl. No.: 12/996,068

(22) PCT Filed: Oct. 7, 2008 (Under 37 CFR 1.47)

(86) PCT No.: PCT/KR2008/005880

§ 371 (c)(1), (2), (4) Date: Dec. 3, 2010

(87) PCT Pub. No.: WO2009/148203

PCT Pub. Date: Dec. 10, 2009

(65) Prior Publication Data

US 2012/0090344 A1 Apr. 19, 2012

(30) Foreign Application Priority Data

Jun. 3, 2008 (KR) ..... 10-2008-0052089
Jun. 12, 2008 (KR) ..... 10-2008-0055090

(51) Int. Cl.
*F25D 23/12* (2006.01)

(52) U.S. Cl.
USPC ..... 62/262; 62/268

(58) Field of Classification Search
USPC ..... 62/262, 298, 259.1, 263, 448, 449; 312/101, 109
See application file for complete search history.

(56) References Cited

FOREIGN PATENT DOCUMENTS

| | | |
|---|---|---|
| DE | 14 54 629 | 2/1969 |
| DE | 93 18 222 | 1/1994 |
| JP | 59-109731 | 6/1984 |
| JP | 62-119333 | 5/1987 |
| JP | 05-203185 | 8/1993 |
| JP | 05-203186 | 8/1993 |
| JP | 08-007284 | 1/1996 |
| KR | 1998-0010172 | 4/1998 |
| KR | 20-2008-0004797 | 10/2008 |

OTHER PUBLICATIONS

International Search Report and Written Opinion issued in PCT Application No. PCT/KR2008/005880 dated Oct. 10, 2010.
Korean Office Action issued in KR Application No. 10-2008-0052089 dated Nov. 30, 2009.
European Search Report dated Oct. 24, 2012.
Korean Notice of Allowance dated Nov. 24, 2010.

*Primary Examiner* — Mohammad M Ali
(74) *Attorney, Agent, or Firm* — KED & Associates LLP

(57) ABSTRACT

The present invention relates to a window kit (200) and a window sealer (400) of an air conditioner (100). The window kit (200) is provided in the exhaust guide means (140) of the movable air conditioner (100) is firmly fixed to the window frame (D) without having a separate connection member. The gap between the windows generated in the installation process of the window kit (200) is effectively shielded by the window sealer (400).

20 Claims, 4 Drawing Sheets

MOVABLE AIR CONDITIONER

TECHNICAL FIELD

The present invention relates to a movable air conditioner.

BACKGROUND ART

A movable air conditioner is a kind of a movable air conditioner of which the inside of a main body is provided with a compressor, a condenser, an evaporator, and a expansion member.

In detail, a bottom surface of the main body of the movable air conditioner is installed with the compressor and is upright installed with the compressor. an upper side of the condenser is upright installed with the evaporator. The condenser and the evaporator may be installed in an intersecting direction or a parallel direction to each other.

Also, a front surface of a case forming an external appearance of the movable air conditioner is provided with a discharge hole, which discharges heat-exchanged indoor air while passing through the evaporator. The upper side and lower side of the tear surface of the case are formed with two suction holes. The indoor air is sucked into the evaporator through the suction holes formed on the lower side. The rear surface of the case is connected with the exhaust means, which exhausts the heat-exchanged indoor air while passing through the condenser. When the discharge end of the exhaust means is connected to an outdoor space, the air passing through the condenser is exhausted to the outdoor.

The exhaust means is generally installed to be communicated with the outdoor space through a window. In this case, in order to communicate the exhaust means with the outdoor space, the window should be opened by a size corresponding to a sectional area of the exhaust means. The discharge end of the exhaust means is positioned at the outdoor through the opened space of the window.

DISCLOSURE OF INVENTION

Technical Problem

It is an object of the present invention to provide a movable air conditioner including a window kit, which can allow a discharge end of an exhaust means of the movable air conditioner to be easily mounted on a gap of a discharge end and can interrupt the flow of air through a gap of the window.

The technical problem achieved by the present invention is not limited to the above-mentioned description and other technical problems can be clearly understood by those skilled in the art from the following description.

Technical Solution

In order to achieve the above-mentioned objects, there is provided a movable air conditioner according to an embodiment of the present invention, including: a main body that has a compressor, a condenser, and an evaporator therein and is movable in an installation space; an exhaust guide means that is extended from the main body and guides air passing through the condenser to an outdoor; and a window kit that is connected to an end of the exhaust guide means and is mounted between a wall frame supporting a window and a window frame constituting the window, wherein the window kit includes: a kit body of which the inside is formed with an exhaust hole communicating with the exhaust guide means;

and a shielding plate that is slidably connected to the kit body to shield a space between the wall frame and the window frame.

Advantageous Effects

With the movable air conditioner according to the embodiments of the present invention forming the above-mentioned configuration, the following effect can be achieved.

Firstly, the window kit installed on the movable air conditioner is firmly fixed a window frame without a separate connection member.

Secondly, the length of the window kit can be controlled to meet the size of the window and the gap generated by opening the window is effectively shielded.

Thirdly, the gap between the windows generated during the installation of the window kit is effectively shielded by a window sealer, making it possible to prevent the efflux of the indoor and the influx of the outdoor air.

Fourthly, the window kit is made of elastic materials and the mount and separation of the window sealer are facilitated without needing the separate adhesive member and no mark remains when removing the window sealer.

MODE FOR THE INVENTION

Hereinafter, embodiments of the present will be described with reference to the accompanying drawings.

Figure 1:
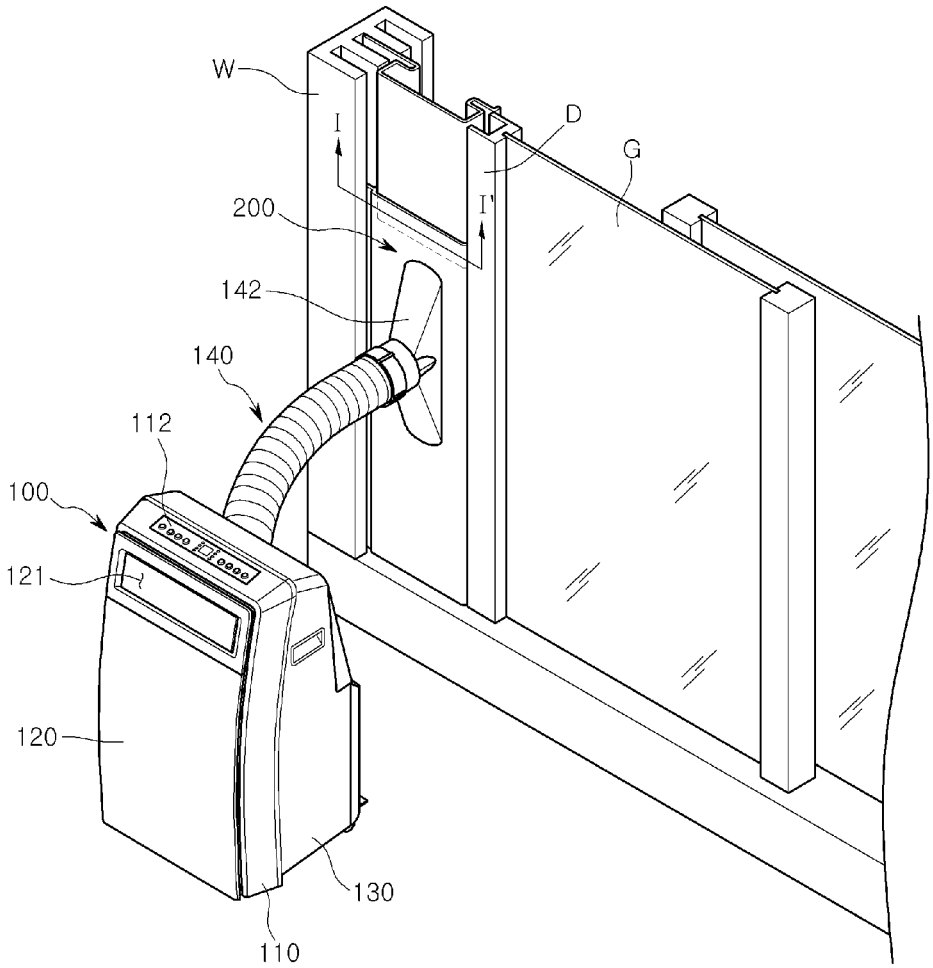
FIG. 1 is a perspective view of an external appearance of mount shape of a movable air conditioner according to an embodiment of the present invention.

FIG. 1 is a perspective view of an external appearance of mount shape of a movable air conditioner according to an embodiment of the present invention.

Referring to FIG. 1, Components inside a movable air conditioner 100 according to an embodiment of the present invention are protected by being accommodated by a front frame 110 and a front panel 120 constituting a front appearance and a rear frame 130 constituting a rear external appearance.

Although not shown, a compressor, a condenser, an expansion member including an expansion valve and a capillary, and an evaporator are accommodated in an inside of the air conditioner 100, wherein the evaporator and the condenser can be provided in an upper side and a lower side, respectively. A condenser fan forcibly sucking indoor air to the condenser and an evaporator fan for forcibly sucking indoor air to the evaporator can be provided near the condenser and the evaporator, respectively.

In detail, a control panel 112 is provided on an upper surface of the front frame 100, such that a user can operate the air conditioner 100. One side of the front surface of the front frame 110 is formed with a discharge hole 121 to discharge the indoor air passing through the evaporator. The rear frame 130 is formed with two suction holes. One sucks the indoor air toward the evaporator and the other sucks the indoor air toward the condenser. The inside of the air conditioner 100 is provided with partition walls, such that the indoor air sucked toward the evaporator and the indoor air sucked toward the condenser are not mixed. An exhaust guide means 140, which exhausts heat-exchanged air to the outside (outdoor) while passing through the condenser, is extended to the one side of the rear frame 130.

More specifically, one end of the exhaust guide means 140 is communicated with the inside of the air conditioner 100 and other end thereof is coupled with a window kit 200 to be described below. The exhaust guide means 140 discharges the refrigerant and heat-exchanged air to the outside in the inside of the air conditioner 100. Therefore, the exhaust guide means 140 has a heat insulator so that the air flowing into the exhaust guide means 140 and the indoor air are not mixed or communicated with each other and may be made of flexible materials to be easily connected with the window kit 200.

A rear end of the exhaust guide means 140 is provided with an exhaust nozzle 142. The exhaust nozzle 142 is a part that is coupled with the exhaust guide means 140 and the window kit 200.

Meanwhile, the window kit 200 is fixedly coupled between the window frame D and the wall frame W. The window kit 200 is a configuration so that a gap between the window wall D and the wall frame W is shielded and only the exhaust guide means 140 is communicated with the outdoor. Herein, the wall frame W refers to the frame installed on a corner of a hole formed on an indoor wall in order to install the window. And, the window frame D refers to the frame installed on the corner portion of a glass G.

In detail, the wall frame W is formed with a plurality of grooves and ribs. The groove for receiving the rib is formed on the edge portion of the window frame D. Therefore, when the window is closed, the rib formed on the wall frame is inserted into the groove formed on the window frame D, thereby forming the thermal insulation. This has the same shape as the general shape of the window frame and therefore, the detailed description thereof will not be repeated.

Hereinafter, the configuration of the window kit 200 will be described in more detail with the accompanying drawings.

Figure 2:
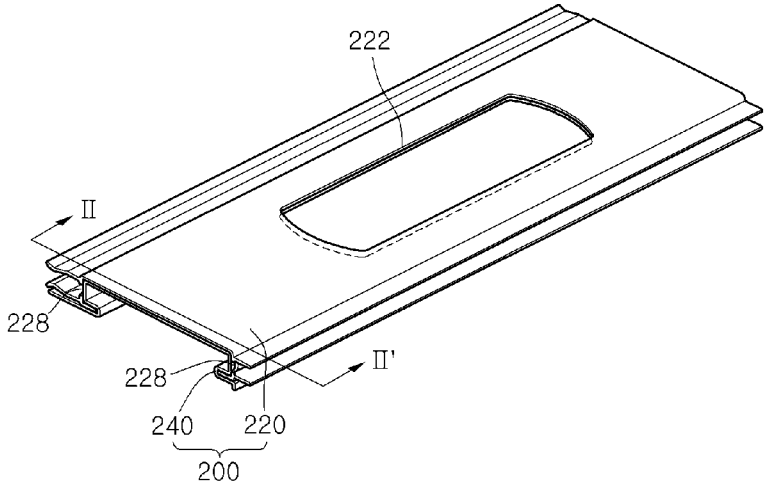
FIG. 2 is a perspective view of an external appearance of the window kit according to an embodiment of the present invention.
Figure 3:
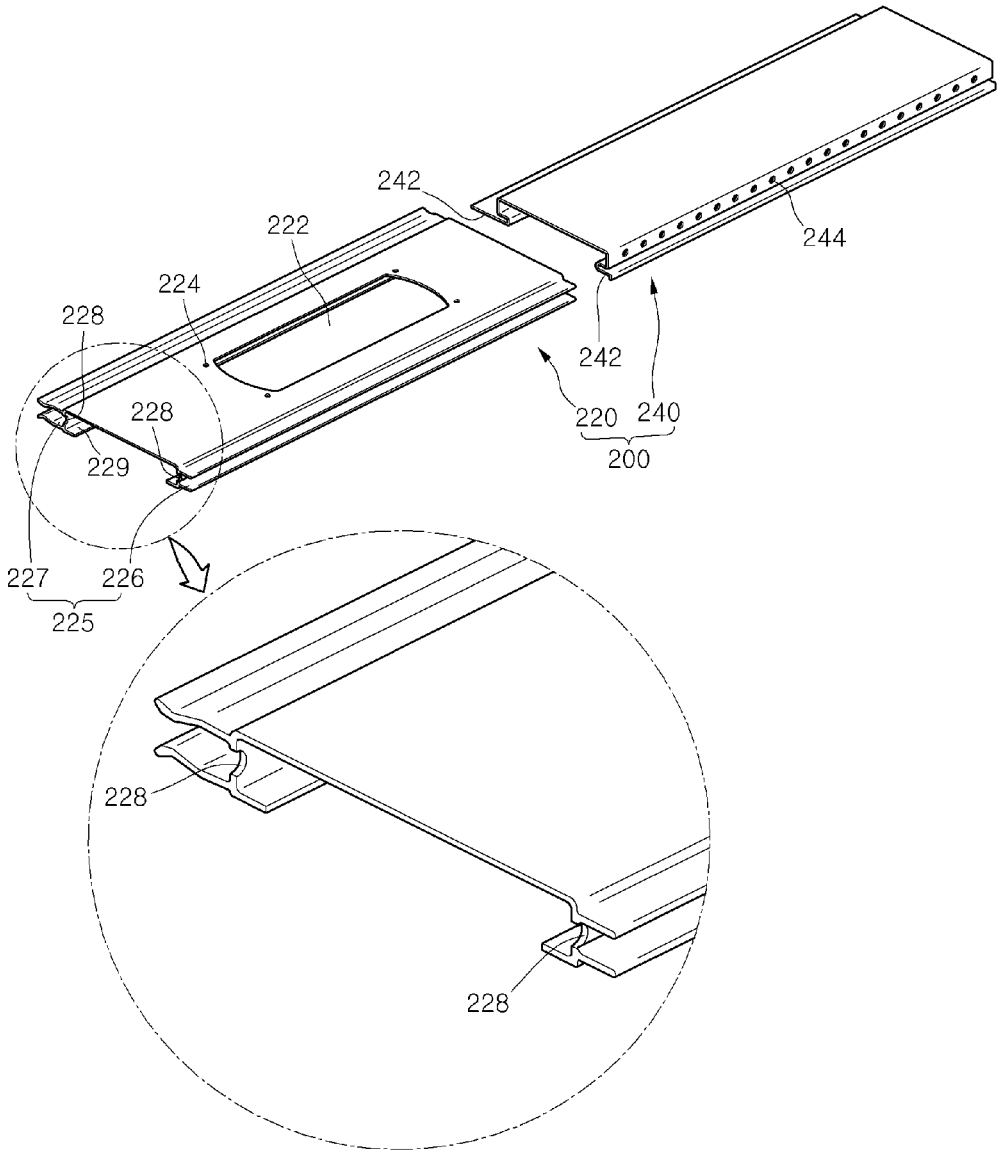
FIG. 3 is an exploded perspective view of the window kit.

FIG. 2 is a perspective view of an external appearance of the window kit according to an embodiment of the present invention and FIG. 3 is an exploded perspective view of the window kit.

Referring to FIGS. 2 and 3, the window kit 200 forms a kit body 220 that is fixed between the window frame D and the wall frame W and a shielding plate 240 that is slidably coupled with the kit body 200. In detail, the kit body 200 is formed with an exhaust hole 222 that is communicated with the exhaust guide means 140. A plurality of connection holes 224 is formed near an edge of the exhaust hole 222, such that the exhaust nozzle 142 is coupled by the connection member. The shielding plate 240 is slidably moved from the kit body 220 along a length of the wall frame W to shield an space between the window frame D and the wall frame W.

Also, a pair of temporal fixing means 225 are extended to the left and right sides of the kit body 220 in front and rear directions, respectively. In detail, the temporal fixing means 225 includes a wall frame fixing part 227 and a window frame fixing part, each of the fixing parts 226, 227 being fowled on both sides of the kit body 220. The wall frame fixing part 222 surrounds the rib projected to a vertical surface of the wall frame W and the window frame fixing part 226 is inserted into a collapse part formed in the window frame D in order to receive the rib of the wall frame W.

Further, a plurality of connection holes 244 may be arranged on the side of the shielding plate 240 at a constant interval and the connection hole 223 (see FIG. 4) corresponding to the connection hole 244 may be formed on the side of the kit body 220. The connection member, such as a screw, penetrates through the connection holes 223, 244, such that it can be fixed to the kit body 220 in the state where the shielding plate 240 is extended by a proper length. Herein, the proper length refers to the length capable of completely shielding the space between the window frame D and the wall frame W.

Moreover, a lower end of the kit body 220 is formed with a receiving groove 220, such that it cannot be interfered with the rib projected from the bottom of the wall frame W. Herein, the window is slidably moved along the rib projected from the bottom of the wall frame W, thereby performing the opening and shutting process of the window. Of course, it is apparent from a structure of a general window frame the groove for receiving the rib is formed on the bottom of the window frame D.

Non-described reference numeral 229 is a separation preventing part and a function thereof will be described below.

Figure 4:
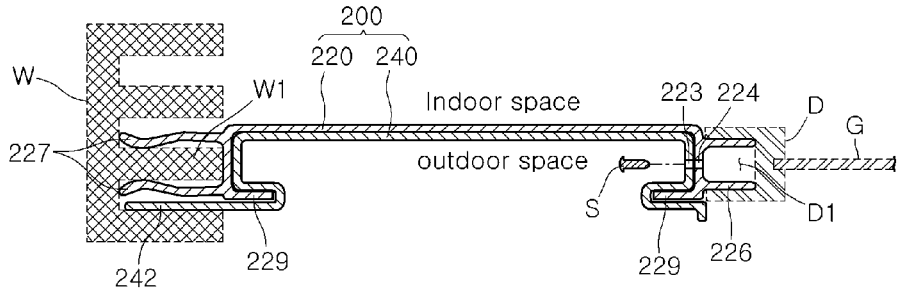
FIG. 4 is a cross-sectional view taken along line I-I' of FIG. 1.

FIG. 4 is a cross-sectional view taken along line I-I' of FIG. 1.

Referring to FIG. 4, the shape where the window kit 200 according to the embodiment of the present invention is coupled to the wall frame W and the window frame D is shown well.

More specifically describing, a surface where the window frame D and the wall frame W are closely adhered to each other, that is, a surface meeting when the window is closed is formed with a rib W1 and a rib receiving groove D1. The window frame fixing part 226 is inserted into the rib receiving groove D1 and the wall frame fixing part 227 receives the rib W1. The pair of the wall frame fixing part 228 is formed to be spaced in the front and rear directions, making it possible to cover the rib W1. The window frame fixing part 226 is provided in a pair, such that it is closely attached to an inner circumferential surface of the rib receiving groove D1.

Further, the wall frame fixing part 227 is extended to have a predetermined width from a side of the kit body 220, such that the two fixing parts facing each other are curved in a direction approaching each other and is then widened in a spaced direction. The two wall frame fixing parts 227 have a predetermined elastic force and the distance spaced from each other is formed to be smaller than a thickness of the rib W1. Therefore, the wall frame fixing part 227 is slightly widened in a process where the rib W1 is inserted between the wall frame fixing par 227, such that it is maintained at a closely attached state to the surface of the rib W1 by its own elastic force.

Also, the two window frame fixing parts 226 are extended in front and rear directions, such that they are closely attached to a front inner circumferential surface and a rear inner circumferential, making it possible to obtain a double sealing effect.

Meanwhile, as described above, the side of the shielding plate 240 and the side of the kit body 220 are formed with connection holes 244, 223 and a connection member S is inserted to penetrates through the connection holes 244, 223, thereby preventing the shielding plate 240 from slide to the lower side along the kit body 220 by its own tare in a state where the window kit 200 is mounted on a window.

Herein, any one of the connection holes 244, 233 is a circular connection hole and the other is a long hole shape, but they all may be circular holes.

Also, both side ends of the kit body 220 are bent backward to form a side part and are back bent in a direction facing each other to form a separation preventing part 229. In detail, the separation preventing part prevents a phenomenon where the shielding plate is separated from the kit body 220 during the transport of the window kit 200. In other words, the shielding plate 240 is slidably moved only along the length direction of the kit body 220 by the separation preventing part, thereby preventing a phenomenon that it is separated in an intersecting direction with the length direction of the kit body 220.

Meanwhile, the shield plate 240 fits into the rear of the kit body and both side parts thereof are bent along the shape of the kit body 220, such that it can smoothly be slid. The shielding plate is bent in a form surrounding the separation preventing part 229 of the kit body 220, such that both side ends thereof have a form bent in a direction facing each other. The side end 242 positioned at the wall frame of both side ends of the shielding plate 240 is extended in the same direction as the wall frame fixing part 227 of the kit body 220, thereby performing the function of the shielding part interrupting the outflow of the indoor and outdoor air.

Figure 5:
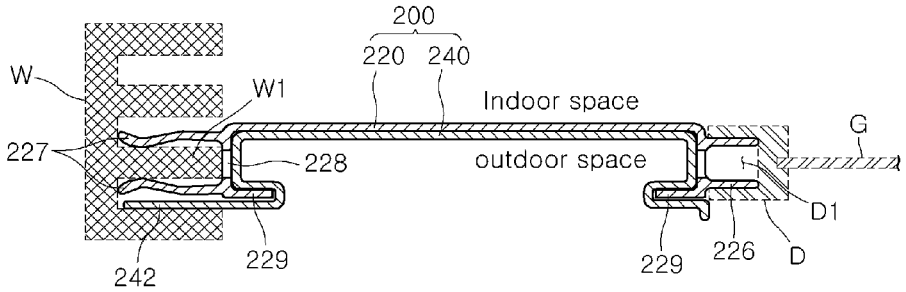
FIG. 5 is a cross-sectional view taken along line I-I' of FIG. 2.

FIG. 5 is a cross-sectional view taken along line I-I' of FIG. 2.

Referring to FIG. 5, the upper end or lower end of the side part of the kit body 220 is collasped a rib receiving groove 228. The rib receiving groove 228 receives the rib (rib in which a lower end of the window frame is seated) projected from the upper surface or bottom surface of the wall frame W, thereby interrupting the air leakage between the lower end part or upper end part of the kit body 220 and the wall frame W. Therefore, it is preferable that the rib receiving groove 228 is collapse to have a shape corresponding to a cross section shape of the rib.

The rib receiving groove 228 is positioned between a plurality of wall frame fixing parts 227. In other words, a rail is formed at a straight position connecting a center of the thickness of the window frame D and the center of the surface where the window frame D and the wall frame W faces each other is provided with projections and grooves coupled to each other.

Therefore, the rib receiving groove 228 may be formed between the pair of wall frame fixing parts 227 and the pair of window frame fixing parts 226.

Hereinafter, the installation process of the window kit 200 configured as above will be described.

First, the shield part 240 is inserted into the rear of the kit body 220 in a state where the kit body 220 and the shielding part 240 are separated. Hereinafter, the window kit 200 stands such that the rib projected from the bottom surface of the wall frame W is inserted into the inside of the rib receiving groove 228. In this state, when the window is closed, the window frame D is moved to the direction approaching the wall frame D. The window frame fixing part 226 is inserted into the collapse part D1 of the window frame D and the window kit 200 is moved to the wall frame W together with the window. The rib W1 projected on the side of the wall frame W is inserted into the wall frame fixing part 227. At this time, the wall frame fixing part 227 generates an elastic restitution force while being widened in an outer side direction, thereby pressing the outer circumferential surface of the rib W1.

Of course, it may be permitted to close the window in a state where the side part is coupled to the side of the wall frame W. And, the shielding plate 240 is extended in a length direction to shield the space between the wall frame W and the window frame D.

At this time, the shielding plate 240 lifts up upwardly, such that the exhaust hole 222 is opened which communicates the outdoor space with the exhaust nozzle 142 are communicated. The sliding of the shielding part 242 is guided by the separation preventing part 229 in a state where the window frame D contacts the rear surface of the wall frame W. The backward (outdoor direction) separation of the shielding plate 240 is prevented by the separation preventing part 229.

If the upper end part of the shielding plate 240 is extended until it contacts the upper surface of the wall frame W, the space spaced between the window frame D and the wall frame W is completely shielded by the window kit. In this state, as shown in FIG. 4, the connection member S sequentially penetrates through the connection holes 223, 224, such that the shielding plate 240 is fixed to the kit body 220, thereby preventing the falling of the shielding plate 240.

For reference, when both sides of the shielding plate 244 are fixed to the window frame D and the wall frame W, respectively, using the connection member, such as a screw, or the like, such that the window kit 200 will more firmly be fixed to the window.

The installation of the window kit 200 is completed according to the above-mentioned process, the exhaust nozzle 142 is positioned at the exhaust hole 222, and the connection member is then connected to the connection hole 224, such that the air conditioner 100 can be communicated with the outdoor by the exhaust guide means 140.

When the shape of the side parts of the wall frame W and the window frame W has an opposed shape to the embodiment of the present embodiment, the shape will be obtained by rotating the window kit 200 by 180°.

Figure 6:
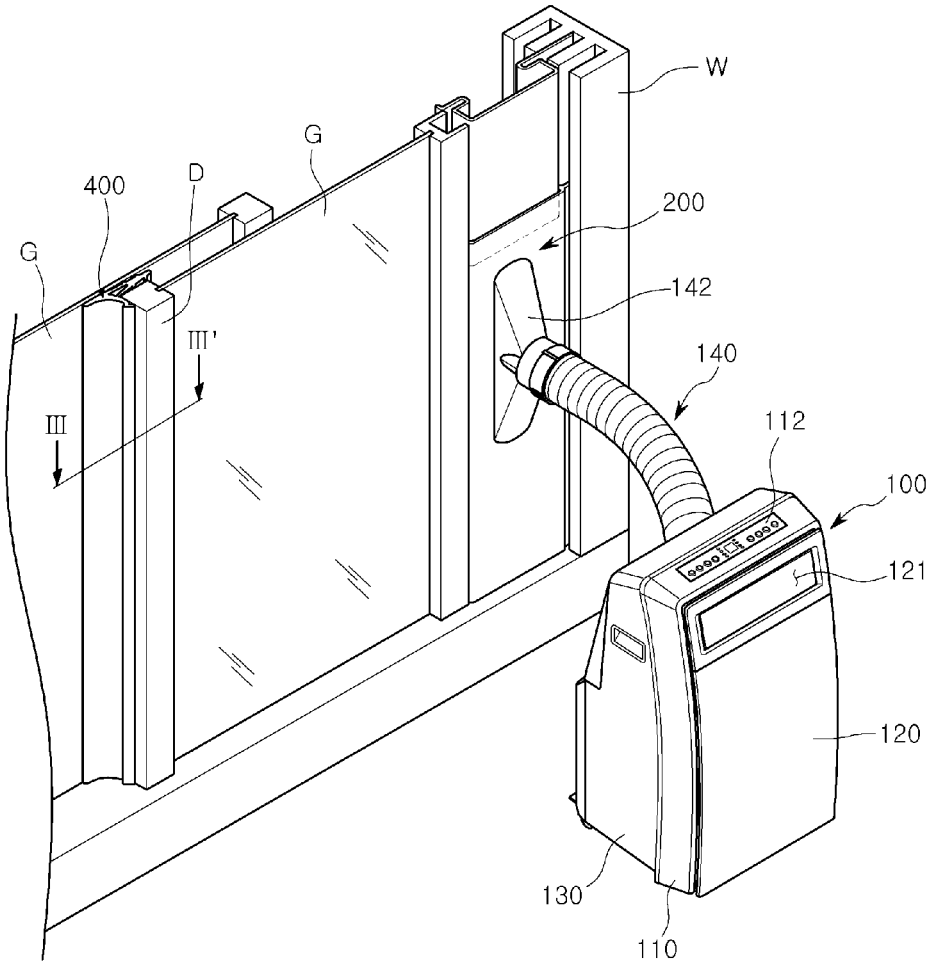
FIG. 6 is a perspective view showing an mount shape of a window sealer according to an embodiment of the present invention.

FIG. 6 is a perspective view showing a mount shape of a window sealer according to an embodiment of the present invention.

Referring to FIG. 6, when the window kit 200 is mounted, the adjacent window frames D are spaced, thereby generating a gap. In other words, a space is formed between glasses G of the adjacent windows, such that the inflow of external air into the inside or the reverse phenomenon occurs, thereby degrading the air conditioning efficiency. In order to interrupt this phenomenon, the gap should be shielded using the window sealer 400 member. Herein, the configuration of the air conditioner 100 and the window kit 200 is the same as the description of FIG. 1 and therefore, the description thereof will not be repeated.

Figure 7:
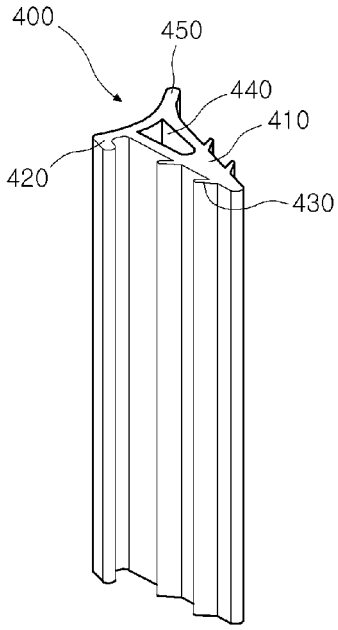
FIG. 7 is a perspective view of an external appearance of the window sealer according to the embodiment of the present invention.
Figure 8:
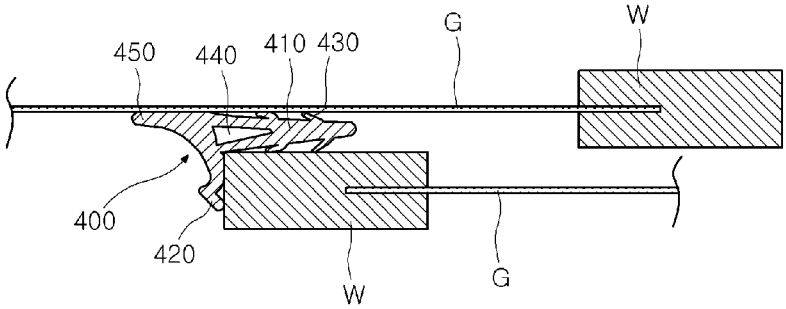
FIG. 8 is a cross-sectional view taken along line III-III' of FIG. 6.

FIG. 7 is a perspective view of an external appearance of the window sealer according to the embodiment of the present invention and FIG. 8 is a cross-sectional view taken along line III-III' of FIG. 6.

Referring to FIGS. 7 and 8, the window sealer 400 according to the embodiment of the present invention may be a pillar shape having an approximately triangular horizontal cross section. The window sealer may be formed of an elastic material in order to improve insertion ability and sealability between the window frame D and the glass G.

The window sealer 400 may be formed to be widened as going to one end from the horizontal cross section. In other words, when viewed from FIG. 7, the right end of the window sealer 400 is first inserted into the gap between the window frame D and the glass G.

Therefore, the window sealer 400 is more inserted in a right direction after the thinnest portion is inserted, such that the window sealer 400 is applied with the gradually increased pressure by the window frame D and the glass G, thereby increasing the sealable force.

Describing the detailed configuration of the window sealer 400, the window sealer 400 includes an inserting part 410 inserted between the window frame D and the glass G, a hanging part 420 that is formed on one side end of the inserting part 410 to limit the insertion depth of the inserting part 410, and an interrupting part 430 that is projected from the outer circumferential surface and is closely attached to the window frame D and the glass G to interrupt air flow.

Also, the inside of the inserting part 410 is formed with a hollow part 440. The hollow part 440 is formed to be penetrate through the inserting part upwardly and downwardly. When the inserting part 410 is compressed by being fitting in the window frame D and the glass G, it serves as a buffer part for reducing the compression amount. If the inside of the inserting part 410 is not formed with the hollow part 440, when the inserting part 410 is fitted between the window frame D and the glass G, the compression amount is suddenly increased from after the insertion part is inserted by a predetermine depth, there may be a problem in that the insertion is not easily made.

Also, the hanging part 420 projected on the one end of the inserting part 410 is closely attached to the window frame D, thereby limiting the insertion depth of the inserting part 410. The hanging part 420 performs a holding function which can be held by a user in the process of separating the window sealer 400.

Also, an opposite side where the hanging part 420 is formed at the inserting part 410 is provided with an elastic force generating part 450. The elastic force generating part 450 is a portion that generates elastic force by contacting the glass G when the inserting part 410 is inserted into the gap between the window frame D and the glass G. In detail, the elastic force generating part 450 is extended to form an obtuse angle to the outer circumferential surface of the inserting part 410, such that the inserting part 410 can completely be attached to the glass G by the elastic force while the inserting part 410 is inserted into the gap.

Also, the plurality of shielding parts 430 are formed to be projected on the outer surface of the inserting part 410. In other words, the plurality of shielding parts 430 is provided on the front and rear of the inserting part 410, respectively. The plurality of interrupting parts 430 can be disposed to be spaced from each other. The interrupting part 430 can be extended to form an obtuse angle to the outer circumferential surface of the inserting part 410 like the elastic force generating part. As a result, when the inserting part 410 is inserted into the gap, it is smoothly inserted to be closely attached to the glass G and the window frame D. In contrast, when the inserting part 410 applies a pulling force to the window sealer 400 in a separated direction from the gap, the resistance force is increased such that the inserting part is not easily separated from the window frame D.

At this time, the window sealer 400 is provided as a single object of an elastic material and does not need a separate adhesive member, such that after the window sealer 400 is removed, it can clearly be separated not to present the residuals.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

The invention claimed is:

1. A movable air conditioner, including:

a main body that has a compressor, a condenser, and an evaporator therein, and the main body is movable in an installation space;

an exhaust guide means that is extended from the main body and guides air passing through the condenser to an outdoor; and a window kit that is connected to an end of the exhaust guide means and is mounted between a wall frame supporting a sliding-door window and a window frame constituting the sliding-door window, wherein the window kit includes:

a kit body of which an inside is formed with an exhaust hole communicating with the exhaust guide means, the kit body to shield a part of a space between the wall frame and the window frame, and a shielding plate that is slidably connected to the kit body to shield a remaining part of the space between the wall frame and the window frame.

2. The movable air conditioner according to claim 1, wherein both sides of the kit body are formed with a temporally fixing means that is closely attached to the wall frame and the window frame, respectively.

3. The movable air conditioner according to claim 2, wherein the temporally fixing means includes:

a wall frame fixing part that is extended to one side surface of the kit body and that receives a rib projected on a side part of the wall frame; and a window frame fixing part that is extended to another side surface of the kit body and that fits in a groove formed on the side part of the window frame.

4. The movable air conditioner according to claim 3, wherein the wall frame fixing part is closely attached to an outer circumferential surface of the rib by an elastic restitution force.

5. The movable air conditioner according to claim 3, wherein at least two wall frame fixing parts are provided to be spaced apart from each other and are bent or curved to be smaller in a spaced distance than a thickness of the rib at any point.

6. The movable air conditioner according to claim 5, wherein when the rib is inserted between the two wall frame fixing parts, the wall frame fixing parts are widened and are closely attached to the outer circumferential surface of the rib by an elastic force.

7. The movable air conditioner according to claim 3, wherein at least two window frame fixing parts are provided to be spaced apart from each other and are closely attached to an inner circumferential surface of the groove.

8. The movable air conditioner according to claim 1, wherein any one of the side part of the kit body and the side part of the shielding plate is provided with a plurality of connection holes and the other is formed with a plurality of connection holes or one long hole.

9. The movable air conditioner according to claim 1, wherein an upper end and/or a lower end of the kit body is formed with a receiving groove in which the rib projected from the wall frame is received.

10. The movable air conditioner according to claim 1, wherein the kit body includes:

a front part;

side parts that are formed to be bent rearward from both side ends of the front part, respectively; and separation preventing parts that are respectively bent at the ends of the side parts in a direction facing each other, to prevent a separation of the shielding plate.

11. The movable air conditioner according to claim 10, wherein the shielding plate is bent along a shape of the kit body at a rear of the kit body, one side end of the shielding plate constitutes a shielding part that is extended to the outside while surrounding the separation preventing part, the shielding part is configured to slidably move in a state where it is closely attached to the wall frame.

12. The movable air conditioner according to claim 1, further comprising a sealer of elastic material inserted into a space between the window frame and a glass of a window adjacent thereto.

13. The movable air conditioner according to claim 12, wherein the sealer includes:

an inserting part inserted into the space;

a hanging part extending at an end of the inserting part to limit an insertion depth; and a plurality of interrupting parts extending at an outer circumferential surface of the inserting part to interrupt air flow.

14. The movable air conditioner according to claim 13, wherein each interrupting part is formed to be tilted in an obtuse angle with respect to the outer circumferential surface of the inserting part.

15. The movable air conditioner according to claim 13, further including an elastic force generating part that is extended from the end of the inserting part at a point opposite to the hanging part, wherein the elastic force generating part is formed to be tilted in an obtuse angle with respect to the outer circumferential surface of the inserting part.

16. The movable air conditioner according to claim 13, wherein the inner side of the inserting part is formed with a hollow part that performs a buffer function for dispersing a compression force generated when the inserting part is inserted into the space.

17. The movable air conditioner according to claim 13, wherein the inserting part has a horizontal cross section that is configured to become wider from one end to the other end.

18. An air conditioner comprising:

a main body that is movable;

a compressor provided at the main body;

a condenser provided at the main body;

an evaporator provided at the main body;

an exhaust guide device to extend from the main body and to guide air to external of the air conditioner; and a window kit to couple to the exhaust guide device, and the window kit is to be provided between a wall frame that supports a sliding-door window and a window frame that forms the sliding-door window, wherein the window kit includes:

a kit body having an exhaust hole to communicate with the exhaust guide device, and the kit body to shield a first part of a space between the wall frame and the window frame, and a shielding plate to slidably couple with the kit body and to shield a second part of the space between the wall frame and the window frame.

19. The air conditioner according to claim 18, wherein both sides of the kit body include a temporally fixing device that is to attach to the wall frame and the window frame, respectively, wherein the temporally fixing device includes:

a wall frame fixing part extended to a first side surface of the kit body and that receives a rib projected on a side part of the wall frame; and a window frame fixing part extended to a second side surface of the kit body and that fits in a groove formed on the side part of the window frame.

20. The conditioner according to claim 19, wherein an end of the kit body is formed with a receiving groove in which the rib projected from the wall frame is received.

* * * * *